US010041252B1

(12) United States Patent
Bongiorno

(10) Patent No.: US 10,041,252 B1
(45) Date of Patent: Aug. 7, 2018

(54) BAR SLEEVE

(71) Applicant: Steven James Bongiorno, Freeport, NY (US)

(72) Inventor: Steven James Bongiorno, Freeport, NY (US)

( * ) Notice: Subject to any disclaimer, the term of this patent is extended or adjusted under 35 U.S.C. 154(b) by 0 days.

(21) Appl. No.: 15/661,258

(22) Filed: Jul. 27, 2017

Related U.S. Application Data

(60) Provisional application No. 62/381,374, filed on Aug. 30, 2016, provisional application No. 62/368,138, filed on Jul. 28, 2016.

(51) Int. Cl.
*E04C 5/16* (2006.01)
*E04C 5/06* (2006.01)

(52) U.S. Cl.
CPC ..... *E04C 5/165* (2013.01); *E04C 5/0622* (2013.01)

(58) Field of Classification Search
CPC ..... E04C 5/165; E04C 5/0622
USPC ..... 52/231, 431, 432, 649.1, 719, 649.2, 52/649.3, 649.7, 649.8
See application file for complete search history.

(56) References Cited

U.S. PATENT DOCUMENTS 3,838,547 A * 10/1974 Meisberger ..... E04H 12/2284 248/444.1
3,957,087 A * 5/1976 Johnston ..... D06B 23/025 138/175
4,553,875 A * 11/1985 Casey ..... E01F 15/086 249/5
5,305,573 A * 4/1994 Baumann ..... E04C 5/165 403/305
5,459,973 A * 10/1995 Baumann ..... E04C 5/165 403/305
5,729,952 A * 3/1998 Dahl ..... E04C 5/165 29/437
7,374,369 B2 * 5/2008 Jakubowski ..... E02D 27/42 405/233
8,375,678 B1 * 2/2013 Ferrer ..... E04C 5/165 52/414
8,381,479 B1 * 2/2013 Ferrer ..... E04C 5/165 52/414
8,387,329 B2 * 3/2013 Stevens ..... E04C 5/0604 52/220.3
8,533,956 B2 * 9/2013 Perry ..... E04C 5/0604 140/112
9,267,287 B1 * 2/2016 Bongiorno ..... B66C 1/62
9,840,844 B2 * 12/2017 Prowse ..... E04C 5/165
9,890,545 B1 * 2/2018 Bongiorno ..... E04G 21/16
2004/0049910 A1 * 3/2004 Barden ..... B21F 27/124 29/700

(Continued)

FOREIGN PATENT DOCUMENTS

JP 08042064 A * 2/1996
JP 2014173418 A * 9/2014

*Primary Examiner* — Brent W Herring
(74) *Attorney, Agent, or Firm* — Alfred M. Walker

(57) ABSTRACT

A sleeve lock locks concrete reinforcing steel bars within rigid support structure retainers for stabilizing the reinforcing bars in place, while allowing the bars to spin freely within sleeves or holes within the retainers. The sleeve locks are stable couplings holding concrete reinforcing bars in position while allowing the bars to spin within the couplings. This reduces the need for tightening locks or fasteners at elevated heights of vertically positioned concrete reinforcing steel bars.

23 Claims, 19 Drawing Sheets

(56) References Cited

U.S. PATENT DOCUMENTS

| | | | | |
|---|---|---|---|---|
| 2009/0100784 | A1* | 4/2009 | Garza | E04C 5/163 52/686 |
| 2011/0120048 | A1* | 5/2011 | Perry | E04C 5/0604 52/745.2 |
| 2012/0291394 | A1* | 11/2012 | Tooman | E02D 27/42 52/699 |
| 2012/0297719 | A1* | 11/2012 | Stevens | E04C 5/0604 52/649.8 |
| 2015/0292207 | A1* | 10/2015 | Prowse | E04C 5/165 52/707 |
| 2017/0081853 | A1* | 3/2017 | Kim | E04G 21/12 |
| 2018/0036788 | A1* | 2/2018 | Stevens | B21F 27/121 |

* cited by examiner

BAR SLEEVE

FIELD OF THE INVENTION

The present invention relates to retainers for stabilizing vertically extending concrete reinforcing steel bars in place at a poured concrete construction site.

BACKGROUND OF THE INVENTION

I have invented certain new and useful improvements for pre-fabricated assemblies of threaded bars, for which Letter Patent were granted on Feb. 23, 2016, U.S. Pat. No. 9,267,287 (Bongiorno '287). These improvement may also be adapted to improve the prefabrication system described in U.S. Pat. Nos. 8,381,479 and 8,375,678 (Ferrer '479 and Ferrer '678). A recitation of the relevant portions of Bongiorno '287, Ferrer '479 and Ferrer '678 are not provided herein since such relevant portions are incorporated by reference herein.

Bongiorno '287 describes a prefabricated assembly of threaded reinforcing bars wherein certain embodiments include, but are not limited to, the use of at least one internally threaded sleeve in the cage frame assembly. Other embodiments utilize smooth bore sleeves with locking means to hold the bars against the sleeves.

In some embodiments of Bongiorno '287, the internally threaded sleeves are first attached to the cage frame assembly and then longitudinal bars are threaded, or rotated, through the internally threaded sleeves (as shown in Prior Art, refer to FIG. 1A). In other embodiments, the internally threaded sleeves are first threaded, or rotated, onto the longitudinal bars and then the internally threaded sleeves with the bars in them are attached to the cage frame assembly (as shown in Prior Art, refer to FIG. 1C). In yet other embodiments, the internally threaded sleeves are split, or openable, type sleeves. In such embodiments, the split sleeves are first attached to the cage frame assembly and then longitudinal bars are placed into, or against, them, with the external threading of the bars aligned with the internal threading of the split sleeve (as shown in Prior Art. refer to FIG. 1B). Then the split sleeves are closed, or otherwise secured.

One of the objects and advantages of Bongiorno '287 is to provide a self-supporting prefabricated reinforcement cage that is strong, stiff and stable when installed in a vertical orientation. Those skilled in the art will recognize the importance of having the ability to maintain a rigid connection between at least some of the reinforcing bars and the upper cage frame of Bongiorno '287, or upper template of Ferrer '479 and Ferrer '678, as the case may be.

Referring to Prior Art FIGS. 2A and 2B, such rigidity is achieved by providing rotational and axial restraint between at least some of the reinforcing bars and the cage frames, or templates, as the case may be. While such restraint can be provided by torqueing opposing lock nuts against the top and bottom faces of a cage frame or template, those skilled in the art will recognize that in an application where the bars are to be rotated for connection to other bars, such clamping action between the opposing lock nuts may oppose such rotation. Alternatively, the bar rotation may cause a loosening of the clamping action between the opposing lock nuts, thus reducing their ability to provide the desired rotational and axial restraint. Restoring that rigidity may require a worker to ascend the reinforcing cage to restore the locks at the upper retainer, which can be at a considerable elevation and thus poses a safety issue. The internally threaded sleeves of Bongiorno '287 allow for free rotation of the bars, while maintaining adequate rotational and axial restraint between the bars and cage frames.

Although each of the above referenced embodiments of Bongiorno '287 achieves the above stated objective of providing rigidity to a reinforcing retainers, such as a cage frame or flat template cage, those skilled in the art will recognize that each of those embodiments has an impact on the time and effort required to fabricate the assembly. For example, installing the longitudinal bars by threading, or spinning, them into the internally threaded sleeves requires temporary supports for alignment and the use of rotating tools or substantial manual effort, which can add time and cost to the fabrication process. This embodiment also may require more space allocation in the shop or in the field for fabrication. Other embodiments may require, for example, temporarily holding the longitudinal bars and respective internally threaded sleeves in position against the cage frames while attachment is made.

OBJECTS OF THE INVENTION

One of the primary objects of the present invention is to achieve the benefits of using the internally threaded sleeves of Bongiorno '287, as discussed previously and depicted in FIG. 2, by replacing them with smooth bore sleeves having a locking mechanism connected to the sleeve that allows the fabrication to be made more efficiently.

Another object of the present invention is to provide an alternative means of temporarily securing the longitudinal bars to, against or within the smooth bore sleeves of Bongiorno '287 and permitting them to be loosened, or unlocked, and tightened, or locked, at any time, while allowing the bars to spin within the smooth bore sleeves.

Yet another object of the present invention is to provide the benefits of Bongiorno '287, as discussed previously and depicted in FIG. 2, to Ferrer '479 and Ferrer '678, thus overcoming some of the major disadvantages of Ferrer '479 and Ferrer '678.

It is therefore an object of the present invention to provide a sleeve lock for locking concrete reinforcing steel bars within rigid support structure retainers for stabilizing the reinforcing bars in place, while allowing the bars to spin within sleeves or holes within the retainers, before the reinforcing bars are erected vertically at a construction site.

It is therefore also an object of the present invention to provide stable couplings, such as sleeve locks, for holding concrete reinforcing bars in position while allowing the bars to spin within the couplings, and which reduces the need for tightening locks or fasteners at elevated heights of vertically positioned concrete reinforcing steel bars.

Other objects will become apparent from the following description of the present invention.

SUMMARY OF THE INVENTION

In keeping with these Objects and others which may become apparent from the following description, the present invention is a retainer assembly with sleeve locks for locking sleeves, that hold concrete reinforcing steel bars within a rigid support structure retainer, and methods for making same, for stabilizing the reinforcing bars in place, while allowing the bars to spin freely within sleeves or holes within the retainers. The sleeve locks are stable couplings holding concrete reinforcing bars in position while allowing the bars to spin within the couplings. This reduces the need for tightening locks or fasteners at elevated heights of vertically positioned concrete reinforcing steel bars.

The retainer assembly first stabilizes a plurality of spaced, horizontally arranged concrete reinforcing bars mounted temporarily on assembly jigs, where the reinforcing bars having an external threading pattern over at least a portion of their length. The retainer assembly includes a plurality of spaced rigid support structure retainers mounted on the reinforcing bars for axially aligning said reinforcing bars for use when erected vertically. A plurality of axially extending holes are rigidly fastened to respective spaced rigid support structure retainers, where one or more retaining sleeves are provided to the spaced rigid support structure retainer, for insertion of a respective concrete reinforcing steel bar therein. Sleeve locks are mounted onto the horizontally arranged concrete reinforcing bars, to engage and lock the retainer sleeves in place on the reinforcing bars, while the reinforcing bars are horizontally arranged.

The reinforcement assembly is lifted vertically into place, after the sleeve locks lock the retainer sleeves in place, thereby avoiding use of workers to climb up for tightening nuts associated with mounting the sleeve locks and sleeves in place upon the respective reinforcement bars.

In one embodiment, the spaced rigid support structure retainers may comprise three dimensional cage frames having integral spaced apart open cage frame sleeves for insertion of each respective concrete reinforcing bar therein. The cage frame sleeves may be integrally part of the three dimensional cage frame, or separate mountable sleeves.

In another embodiment, the spaced rigid support structure retainers may comprise flat templates having spaced apart holes for insertion of each respective concrete reinforcing bar therein. In this embodiments, the sleeve of the spaced rigid support structure retainer may comprise a separate mountable sleeve.

BRIEF DESCRIPTION OF THE DRAWINGS

The present invention can best be understood in connection with the accompanying drawings. It is noted that the invention is not limited to the precise embodiments shown in drawings, in which.

Views of external

DRAWINGS—REFERENCE NUMERALS

Figure 1A:
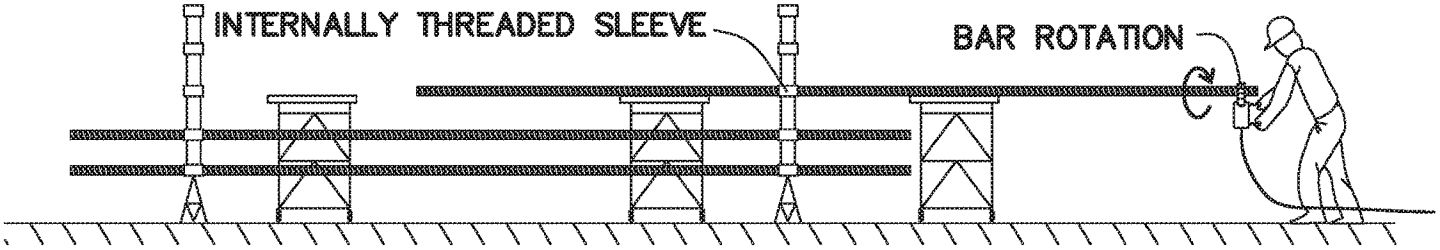
FIG.1A (PRIOR ART)
FIG. 1A is a Prior Art side elevational view of the installation of threaded concrete reinforcing bars within internally threaded cage sleeves of rigid support structure retaining cage frames.
Figure 1B:
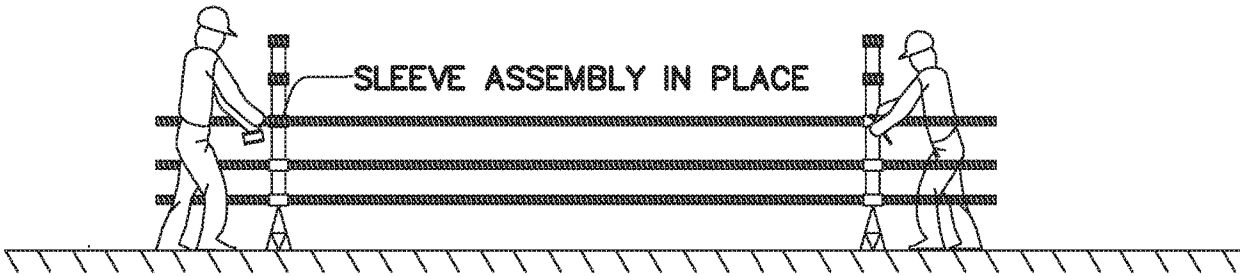
FIG.1B (PRIOR ART)
FIG. 1B is a Prior Art side elevational view of the installation of concrete reinforcing bars within split sleeves of retaining cage frames.
Figure 1C:
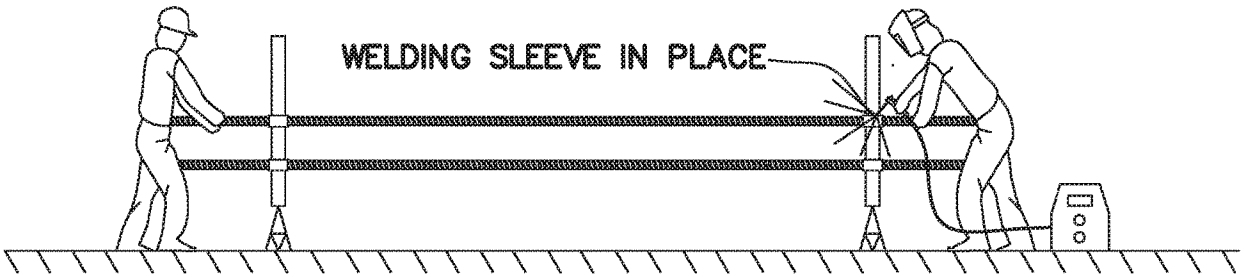
FIG.1C (PRIOR ART)
FIG. 1C is a Prior Art side elevational view of threaded sleeve assemblies fabricated in place on concrete reinforcing bars.
Figure 2A:
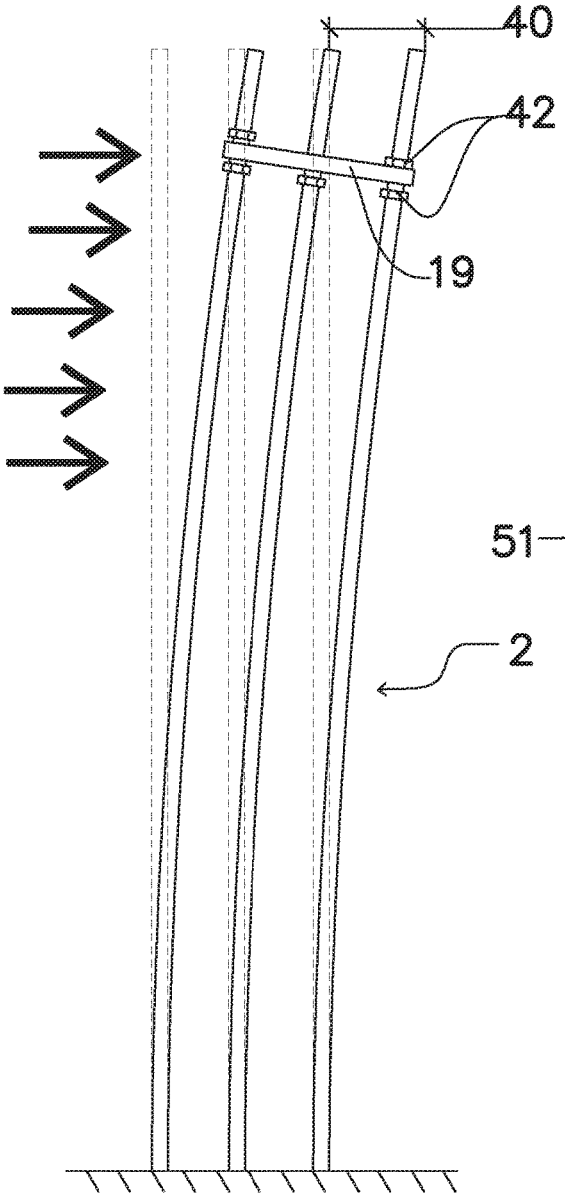
FIGS. 2A and 2B are diagrammatic side elevational views showing forces expanded against vertically installed reinforcing bars and displaced profiles thereof.
Figure 2B:
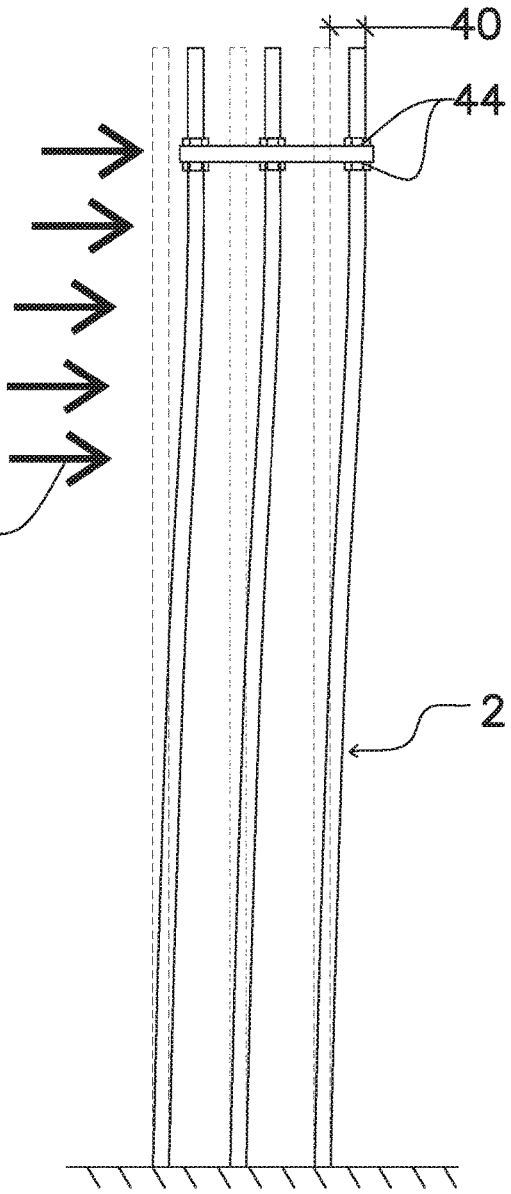

For illustrative purposes only, a preferred mode for carrying out the invention is described herein, wherein the following reference numerals are non-limiting examples.

1. Longitudinal Reinforcing Bar
2. Prefabricated Reinforcing Cage
3. Cage Frame Plate
4. Template
5. Sleeve
7. Sleeve Lock
8. Internally Threaded Makeup Collar
9. Major Threading in the Sleeve Lock
10. Major Threading in the Internally Threaded Makeup Collar
11. Minor Threading in the Sleeve Lock
13. Minor Threading on the Sleeve
15. Welds
17. Assembly Jig
19. Cage Frame
21. Lock Nuts
23. Lock Collar
24. Internal Threading in Lock Collar
25. Externally Threaded Ring
27. Internally Threaded Compression Ring
29. Hole
31. Fasteners
35. Internal Makeup Spacer Sleeve
38. Non-Cylindrical Sleeve
40. Deflection
42. Connection Lacking Rotational and Axial Restraint
44. Connection Providing Rotational and Axial Restraint
46. Internally Threaded Collar or Nut
47. Top Cage Frame
48. Top Template
49. Bottom Cage Frame
50. Bottom Template
51. External Loading

DETAILED DESCRIPTION OF THE INVENTION

The subject of the present invention will now be described, with reference to the accompanying drawings shown in FIGS. 1A-19B. Where similar components are shown in multiple figures, the respective description of the parts may not be repeated.

Referring to FIGS. 3A-4B, a sleeve (5) is preferably comprised of an axially extending hollow cylindrical shape preferably made of steel. The sleeve (5) is provided with threading (13) around at least one end of the outer periphery of the sleeve (5). This threading will hence forth be referred to as the minor threading on the sleeve (13), to distinguish from other threading referenced in this application. Those skilled in the art will be familiar with the common process of making, or cutting, threads into the external face of hollow cylindrical objects such as pipes and tubes. Such threading may be tapered, as is commonly the case for plumbing piping, or un-tapered.

The length, pitch, depth, angle, etc. of the minor threading on the sleeve (13) is determined by design calculation to be sufficient to transmit the calculated forces as well as provide the desired rigidity. The minor external threading on the sleeve (13) is to be compatible with the minor internal threading in the sleeve lock (7), described below, to permit the sleeve lock (7) to be rotated onto the sleeve (5).

A sleeve lock (7) is preferably comprised of an axially extending hollow substantially cylindrical shape preferably made of steel. The outer surface of the sleeve lock (7) may be provided with a flat or segmented profile, similar to a hex nut, over at least some portion of its surface to facilitate rotating or spinning the sleeve lock (7) over the bar (1) using common tools such as wrenches and sockets. The sleeve lock (7) is provided with threading (11) around the inner circumference at the end that will be threaded onto the minor threading on the sleeve (13). This threading will hence forth be referred to as the minor threading in the sleeve lock (11), to distinguish from other threading referenced in this application. Those skilled in the art will be familiar with the common process of making, or cutting, threads into the inner circumferential al surface of a hollow object, such as for example couplings for piping and threaded rods.

The minor threading in the sleeve lock (11) is complimentary to the minor threading on the sleeve (13) to permit the sleeve lock (7) to be rotated onto the sleeve (5). The length, pitch, depth, angle, etc. of the minor threading in the sleeve lock (11) is similarly determined by design calculation to be sufficient to transmit the calculated forces as well as provide the desired rigidity.

The sleeve lock (7) is additionally provided with threading (9) around the inner circumference of the sleeve lock (7) away from the minor threading in the sleeve lock (11). This threading will hence forth be referred to as the major threading in the sleeve lock (9). The length, pitch, depth, angle, etc. of the major threading in the lock sleeve (9) is similarly determined by design to be sufficient enough to transmit the calculated forces as well as provide the desired rigidity. The major threading in the sleeve lock (9) is complimentary to the external threading pattern of the longitudinal reinforcing bars (1). Those skilled in the art will be familiar with such threading used with so-called "threaded bar systems" supplied by companies such as Dywidag Systems International, Skyline Steel, Williams Form Engineering and SAS Stressteel, to name a few.

Figure 5A:
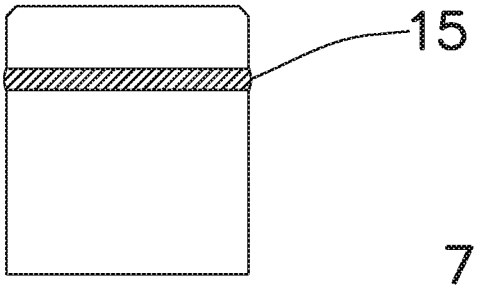
FIG. 5A is a side elevational view of the sleeve lock of the present invention made from separate pieces welded together.
Figure 5B:
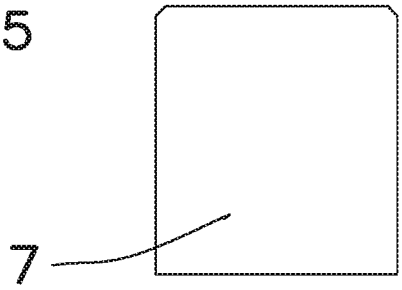
FIG. 5B is an elevational view of the sleeve lock of the present invention made from a single piece.
Figure 6A:
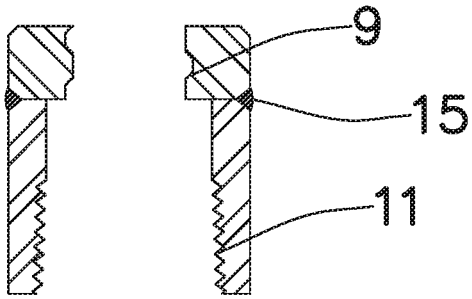
FIG. 6A is a cross sectional view of the welded sleeve lock shown in FIG. 5A.
Figure 6B:
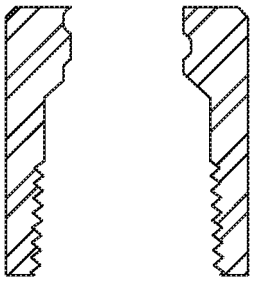
FIG. 6B is a cross sectional view of the single piece sleeve lock shown in FIG. 5B.
Figure 6C:
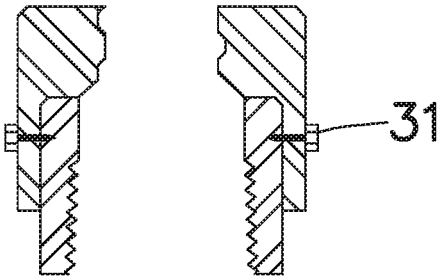
FIG. 6C is a cross sectional view of a two piece sleeve lock, where the pieces are joined together by one or more fasteners.

Referring to FIGS. 5A-6C, the sleeve lock (7) is preferably comprised of a single piece, as in FIGS. 5B and 6B, but may be fabricated from separate pieces joined together as in FIGS. 5A, 6A and 6C, such as by welding (15) or fasteners (31).

In keeping with the objects of the present invention, and others which may become apparent, the cage frame of Bongiorno '287 is adapted to utilize at least one sleeve (5) with a sleeve lock (7) of the present invention, said sleeves (5) being attached to the cage frame of Bongiorno '287 in the same manner as the smooth bore sleeves of Bongiorno '287, as described therein.

Figure 8A:
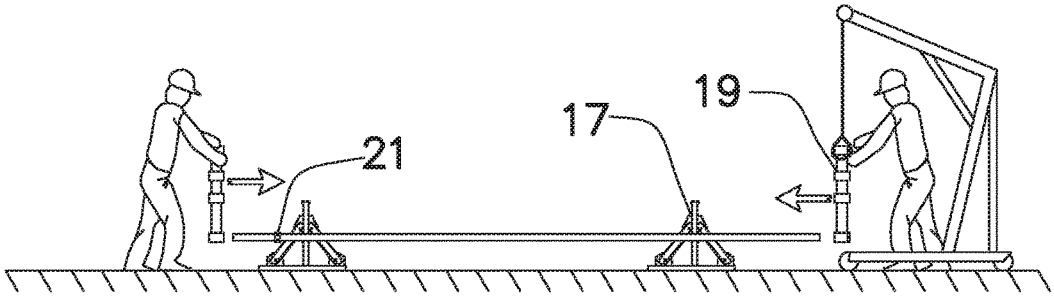
FIG. 8A is an elevation view of the installation of a cage frame of a prefabricated reinforcement cage using the bar sleeve of the present invention.
Figure 8B:
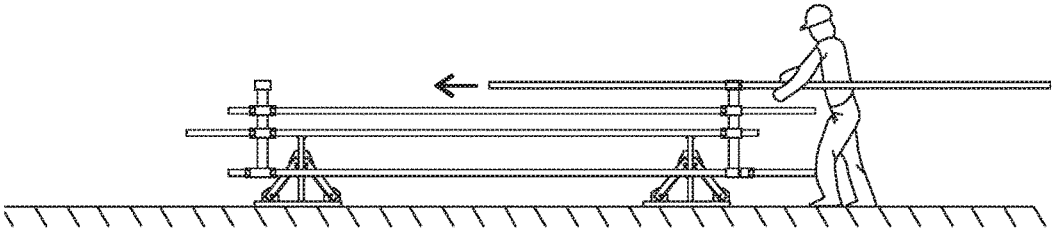
FIG. 8B is an elevation view of the installation of a reinforcing bar through a cage frame of a prefabricated reinforcement cage of FIG. 8A using the bar sleeve of the present invention.

Referring to FIG. 8A, a pre-fabricated reinforcement cage may be constructed in a shop or at the site by first positioning some or all of the longitudinal reinforcing bars with the use of assembly jigs (17), setting rigid support structure retainers, such as the cage frames (19) into position onto the longitudinal reinforcing temporarily with the use of holding or positioning means, such as lock nuts (21) for example. The remaining bars are then charged through the remaining sleeves, as shown in FIG. 8B.

Figure 8C:
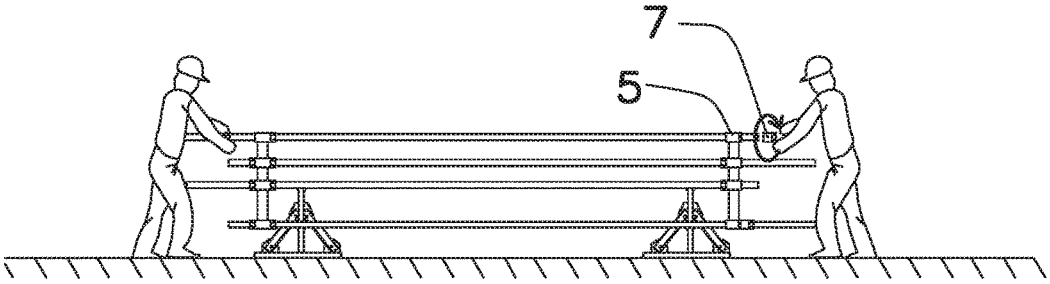
FIG. 8C is an elevation view of the installation of the sleeve lock of one embodiment of the present invention onto the longitudinal bar in preparation for connection with the sleeve.
Figure 9A:
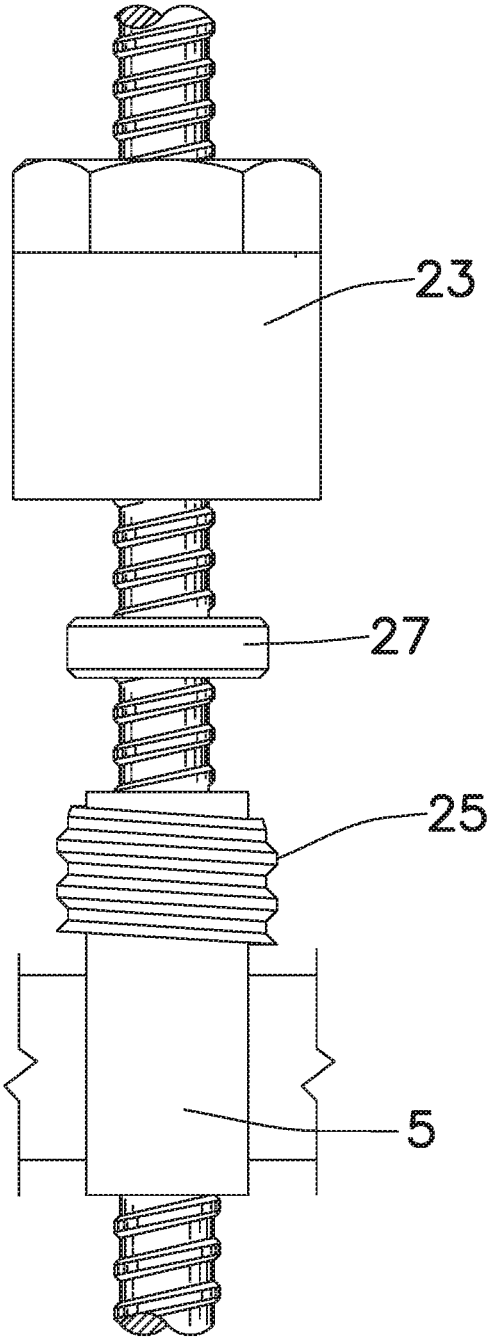
FIG. 9A is an elevation view of the sleeve, lock collar and internally threaded compression ring of one embodiment of the present invention before they are connected together upon a threaded reinforcing steel bar.
Figure 9B:
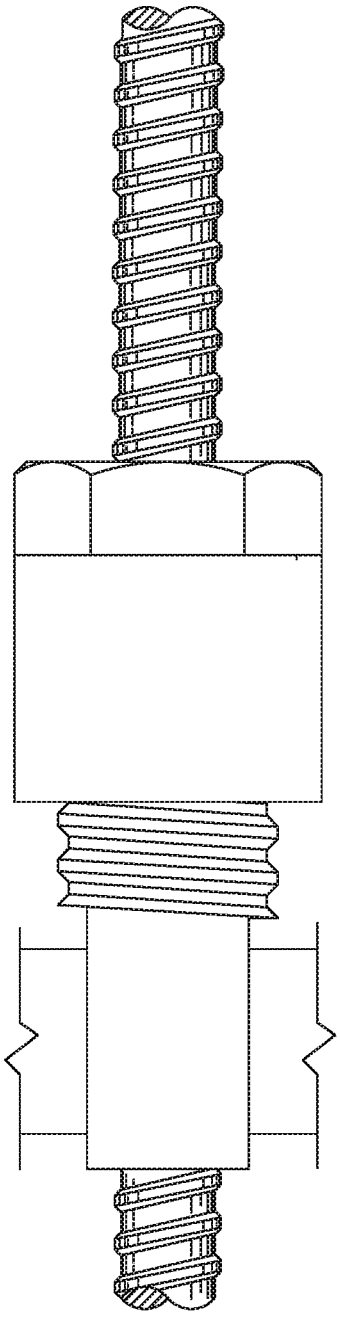
FIG. 9B is an elevation view of the sleeve, lock collar and internally threaded compression ring in FIG. 9A after they have been connected together upon a threaded reinforcing steel bar.

Referring to FIG. 8C, the sleeve locks (7) are threaded, or rotated, onto the respective longitudinal bars passing through the sleeves (5) in the thus positioned cage frames. The sleeve locks (7) are threaded, or rotated, onto the sleeve (5). When the size 2 and pitch of the minor threading in the sleeve lock (11) does not match that of the major threading in the sleeve lock (9), those skilled in the art will understand that there may be movement of the longitudinal bars relative to the positioned cage frames because of the dissimilar thread pattern.

Referring to FIGS. 9A-10B, in another embodiment, at least one sleeve (5) is provided with an externally threaded ring (25) fastened around at least one end of the outer periphery of the sleeve (5), preferably by welding (15). Alternatively, the sleeve (5) can be made integrally with such externally projected threading, such as by forging.

The length, pitch, depth, angle, etc. of the threading on the externally threaded ring (25) is determined by design calculation to be sufficient to transmit the calculated forces as well as provide the desired rigidity. Threading on the externally threaded ring (25) is to be compatible with the minor internal threading in the lock collar (23), described below, to permit the lock collar (23) to be rotated onto the externally threaded ring (25) freely but snugly.

A lock collar (23), is preferably comprised of an axially extending hollow substantially cylindrical shape preferably made of steel. The lock collar (23) is provided internal threading (24) around the inner circumference at the end that will be threaded onto the externally threaded ring (25) of the sleeve (5). Those skilled in the art will be familiar with the common process of making, or cutting, threads into the inner circumfereral surface of a hollow object, such as for example couplings for piping and threaded rods. The lock collar (23) is provided with and annular space around the end opposite the end that will be threaded onto the externally threaded ring (25) of the sleeve (5). This annular space is preferably a circular hole through the end of the lock collar (23) and is sized to permit free movement of the reinforcing bar through the lock collar (23).

Figure 10A:
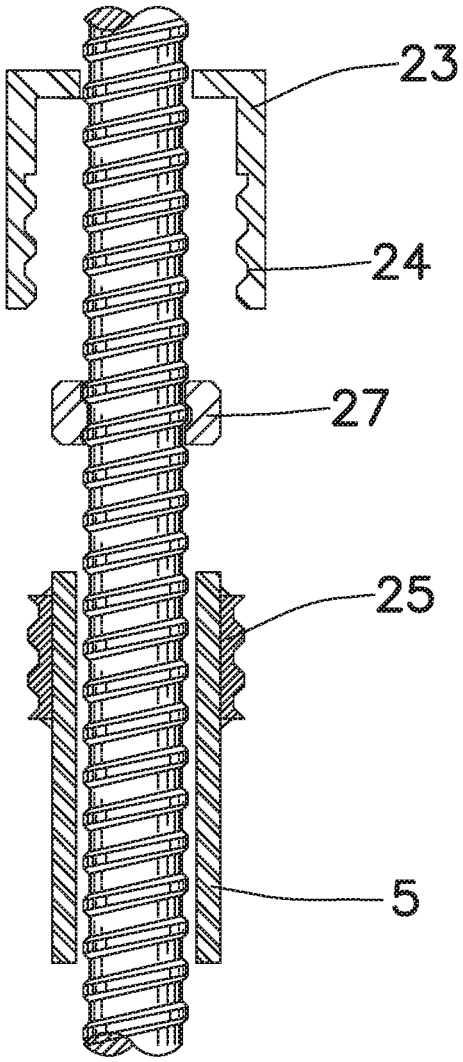
FIG. 10A is a cross sectional view of the sleeve, lock collar and internally threaded compression ring of the embodiment shown in FIG. 9A.
Figure 10B:
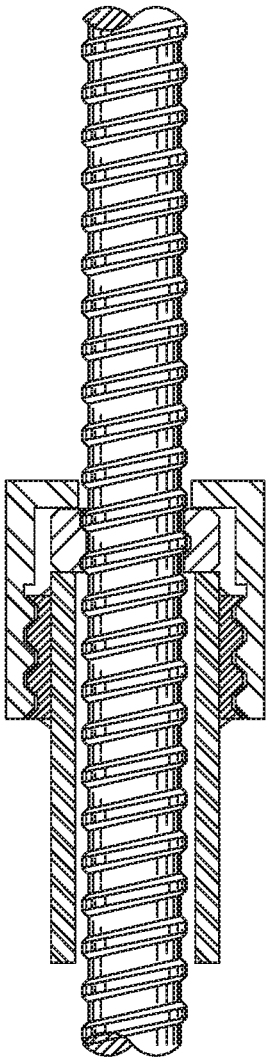
FIG. 10B is a sectional view of the sleeve, lock collar and internally threaded compression ring joined together, as shown in FIG. 9B.

An internally threaded compression ring (27) is preferably comprised of an axially extending hollow substantially cylindrical shape preferably made of steel. The internally threaded compression ring (27) is provided with threading around the inner circumference that is complimentary to the thread pattern of the reinforcing bar. The dimensions of the internally threaded compression ring (27), lock collar (23) and externally threaded ring (25) and sleeve (5) are sized as to allow the internally threaded compression ring (27) to spin freely along the bar and come to bear against the sleeve (5), and for the lock collar (23) spin freely along the bar and pass over the compression ring (27) to be able to be threaded freely onto the externally threaded ring (25), while having the inner end of the lock collar (23) bear against the complimentary end of the compression ring (27). Thus, the lock collar (23) can be tightened, or torqued, against the externally threaded ring (25) through compressive bearing against the compression ring (27). The compression ring (27), in turn bears against the end of the sleeve (5). The thus connected parts, shown in FIG. 10B provide rotational and axial rigidity through the load transfer mechanism between compression bearing between the lock collar (23), compression ring (27) and sleeve (5), and connection between the external threading of the externally threaded ring (25) and the internal threading of the lock collar (24).

Figure 7A:
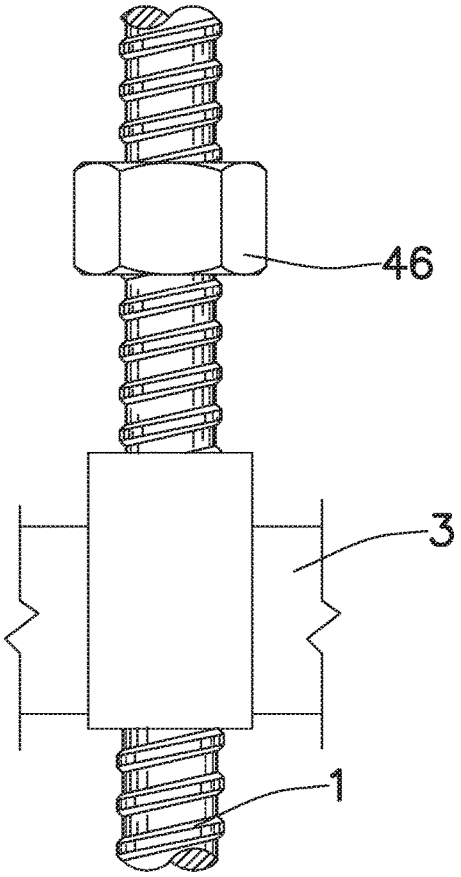
FIG. 7A is an elevation view of the sleeve and internally threaded collar of another embodiment of the present invention before they are connected by welding.
Figure 7B:
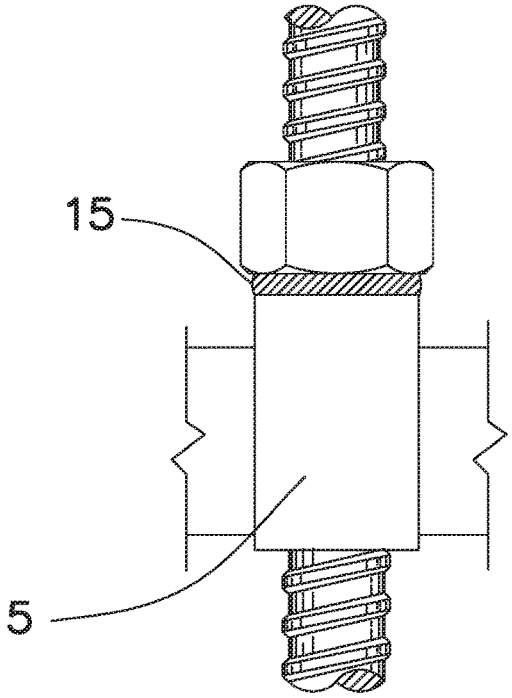
FIG. 7B is an elevation view of the sleeve and lock collar in FIG. 7A after they have been connected together by welding.

Referring to FIGS. 7A-7B, in another embodiment, the objects of the present invention can be achieved by first installing an internally threaded lock collar (23) onto the reinforcing bar (1) after it has been charged through the respective sleeve (5) in the cage frame until it comes in contact with the face of the respective sleeve (5). The thus installed internally threaded lock collar (46) is then rigidly attached to the respective sleeves (5) such as by welds (15). The internally threaded lock collar (23) is preferably comprised of steel and having internal threading that is complimentary to the external threading pattern of the horizontally or vertically extending longitudinal reinforcing bars (1). Such internally threaded elements are commonly used as nuts and couplers with so-called "threaded bar systems" supplied by companies such as Dywidag Systems International, Skyline Steel, Williams Form Engineering and SAS Stressteel, to name a few.

Figure 11A:
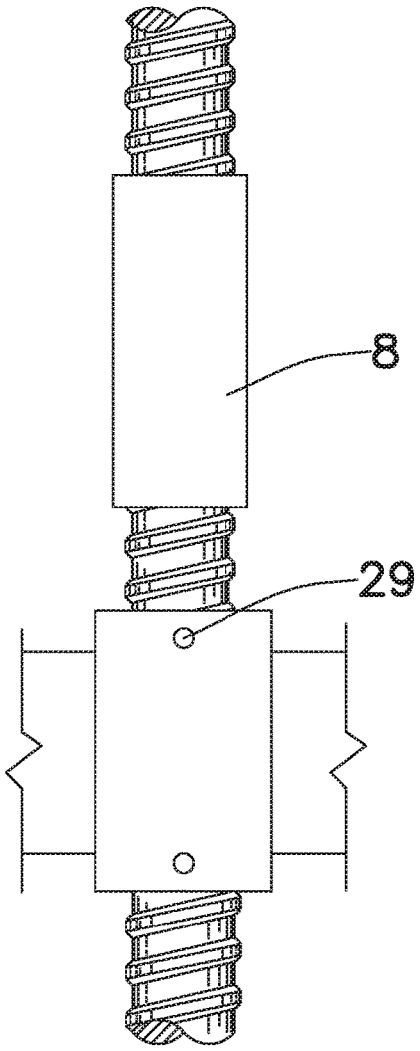
FIG. 11A is an elevation view of the sleeve and internally threaded makeup collar of another embodiment of the present invention before they are connected together upon a threaded reinforcing bar.
Figure 11B:
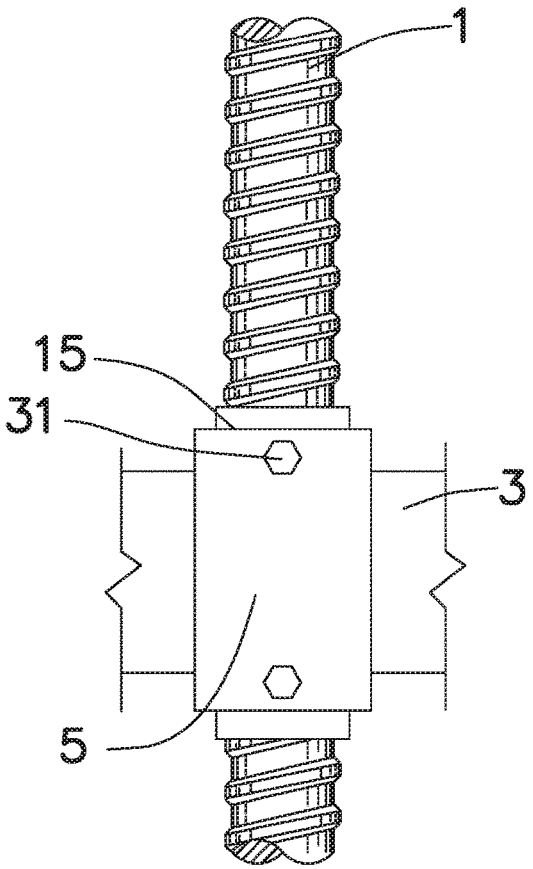
FIG. 11B is an elevation view of the sleeve and internally threaded makeup collar Shown in FIG. 11A after they have been connected together by a fastener upon a threaded reinforcing bar.

Referring to FIGS. 11A-11B, in another embodiment, the objects of the present invention can be achieved by rigidly attaching an internally threaded makeup collar (8) to at least one of the smooth bore sleeves (5) of Bongiorno '287. The internally threaded makeup collar (8) is preferably comprised of a steel cylindrical section having internal threading that is complimentary to the external threading pattern of the longitudinally extending reinforcing bars (1). Such internally threaded elements are commonly used as couplers with so-called "threaded bar systems" supplied by companies such as Dywidag Systems International, Skyline Steel, Williams Form Engineering and SAS Stressteel, to name a few. The internally threaded makeup collar (8) and respective smooth bore sleeve (5) are of a size and shape to allow the threaded makeup collar (8) to travel freely within the smooth bore sleeve (5). A bushing (not shown), made preferably of plastic, can be inserted into the annular space between the internally threaded makeup collar (8) and respective smooth bore sleeve (5) to vary the gap between the two, while still ensuring free movement. At least one fastener (31) is installed through plain or thread tapped holes (29) in the smooth bore sleeve (5). The fasteners (31) are preferably provided with pointed tips. The smooth bore sleeves (5) are optionally provided with serrations over at least a portion of the inner circumference to enhance frictional resistance. Those skilled in the art will recognize such locking screw fasteners and internally serrated surfaces that are similarly used with reinforcing splicing couplers such as those provided by Lenton and BarSplice, to name a few.

Figure 12A:
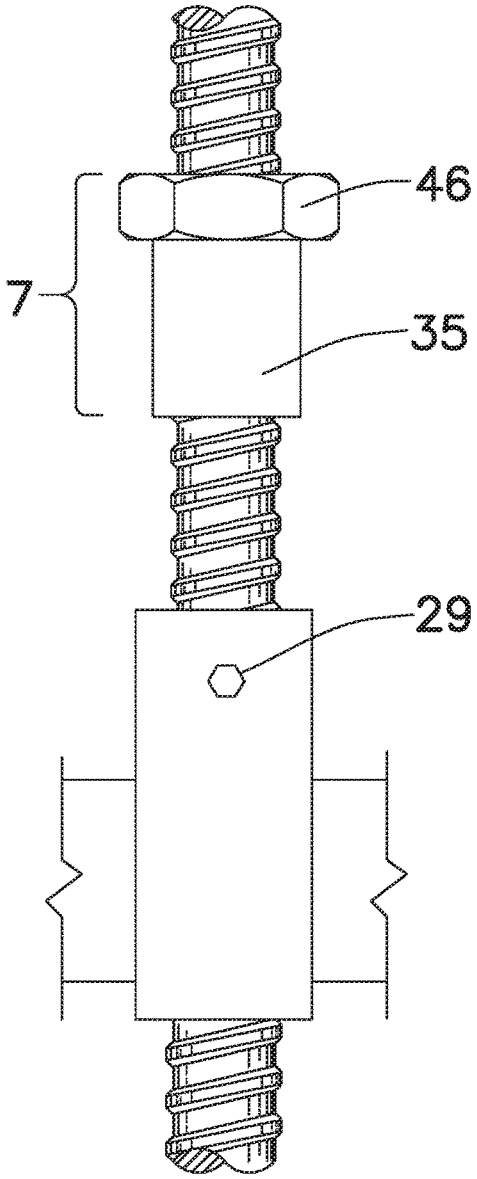
FIG. 12A is an elevation view of the sleeve and sleeve lock with the internal makeup spacer sleeve of another embodiment of the present invention before they are connected together upon a threaded reinforcing bar.
Figure 12B:
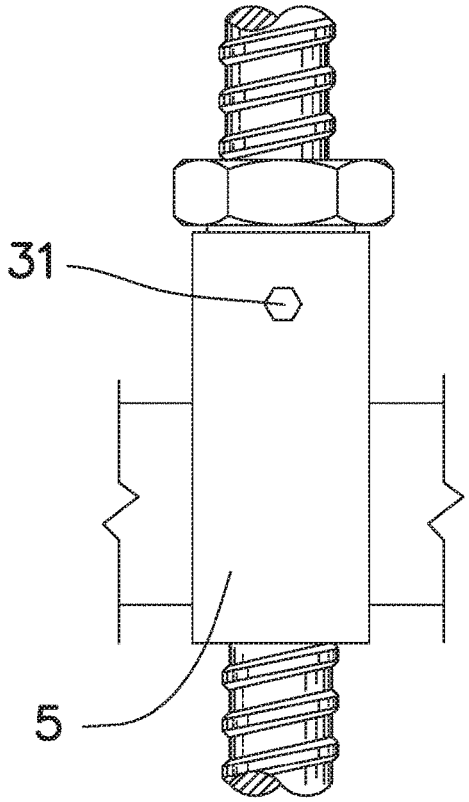
FIG. 12B is an elevation view of the sleeve and sleeve lock with the internal makeup spacer sleeve shown in FIG. 12A after they have been connected together by a fastener upon a threaded reinforcing bar.

Referring to FIGS. 12A and 12B, in another embodiment, the objects of the present invention can be achieved by attaching an internal makeup spacer sleeve (35) to an internally collar or nut (46). The internal makeup spacer sleeve (35) is preferably comprised of a steel cylindrical section. The internal makeup spacer sleeve (35) and respective smooth bore sleeve (5) are of a size and shape to allow the internal makeup spacer sleeve (35) to travel freely within the smooth bore sleeve (5). The annular space between the two is preferably minimized to ensure snugness. At least one fastener (31) is installed through plain or thread tapped holes (29) in the smooth bore sleeve (5). The fasteners (31) are preferably provided with pointed tips.

Figure 3A:
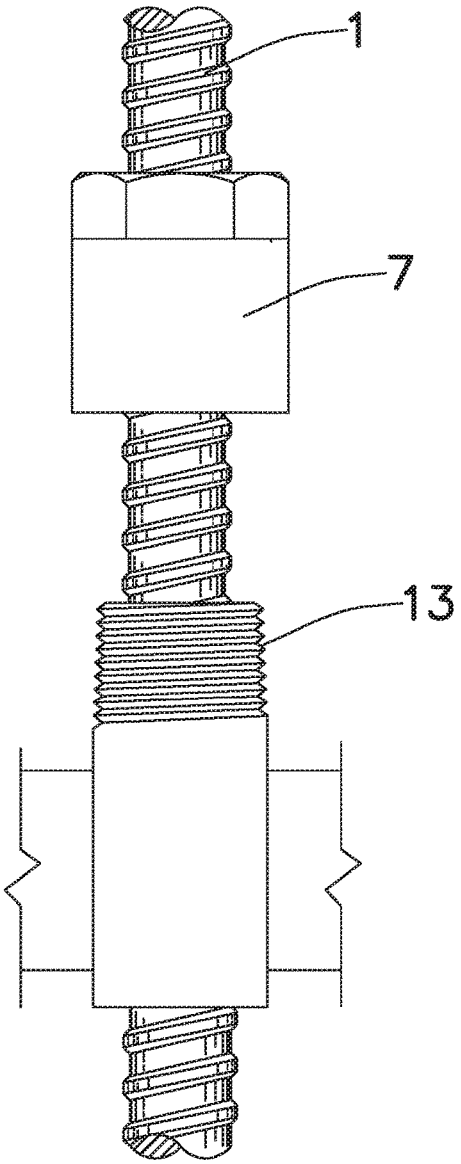
FIG. 3A is an elevation view of the sleeve and sleeve lock of one embodiment of the present invention before they are connected upon a threaded reinforcing bar.
Figure 3B:
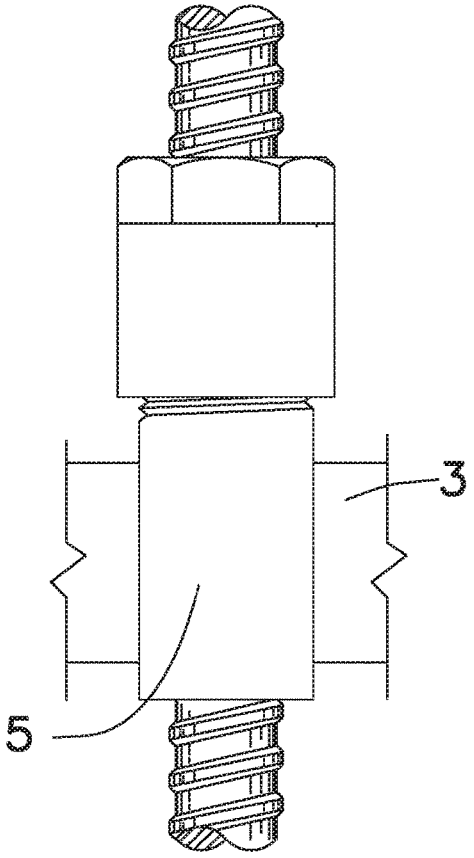
FIG. 3B is an elevation view of the sleeve and sleeve lock in FIG. 3A after they have been connected together upon a threaded reinforcing bar.
Figure 4A:
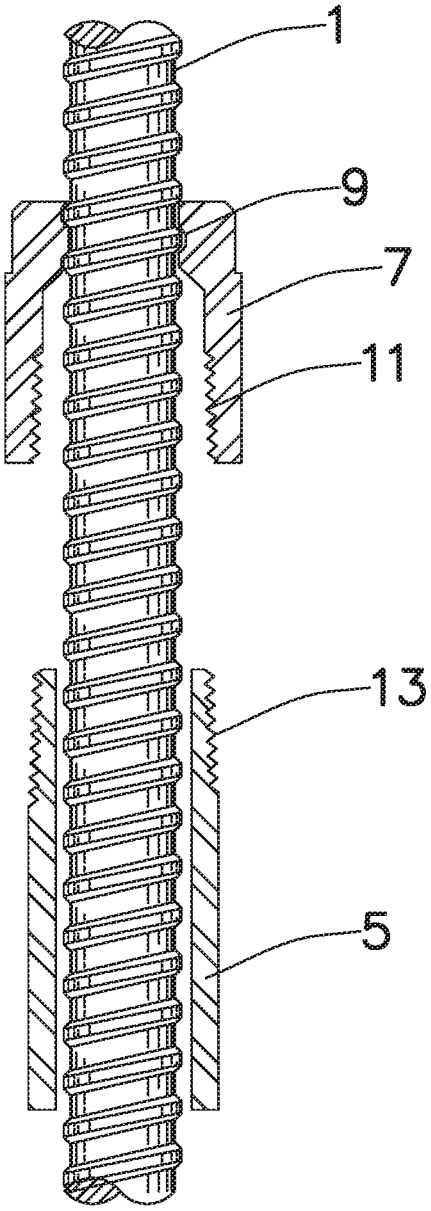
FIG. 4A is a cross sectional view of the sleeve and sleeve lock shown in FIG. 3A.
Figure 4B:
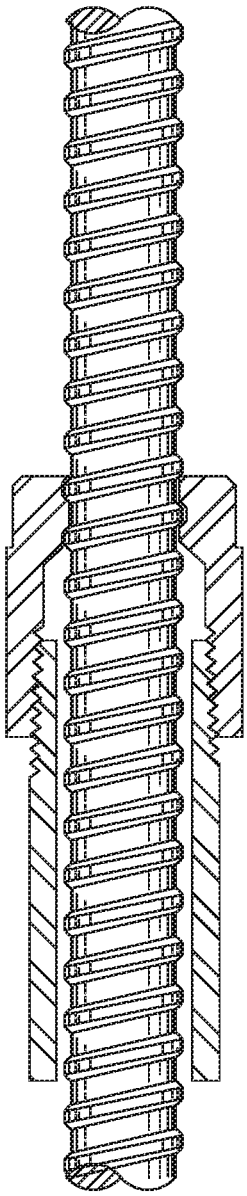
FIG. 4B is a cross sectional view of the sleeve and sleeve lock shown in FIG. 3B.
Figure 13A:
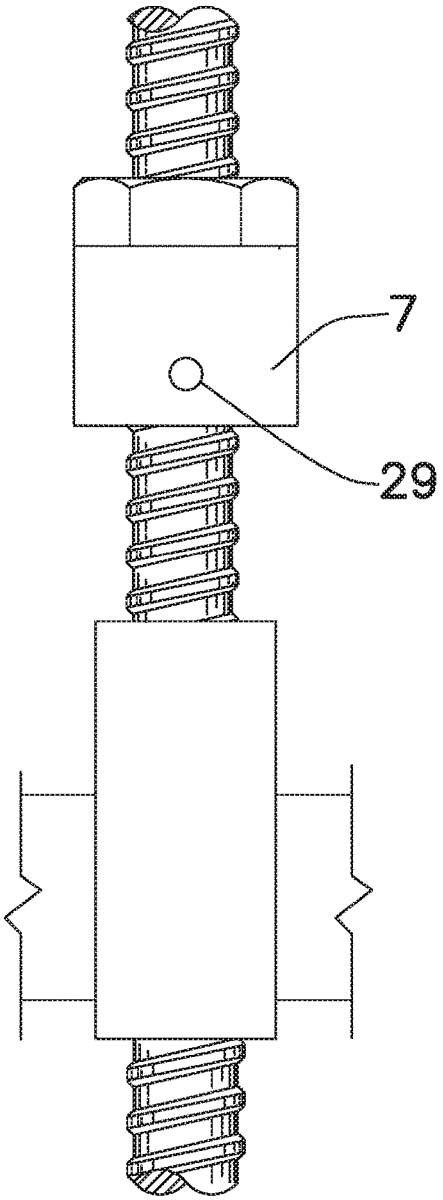
FIG. 13A is an elevation view of the sleeve and sleeve lock with one or more fasteners of another embodiment of the present invention before they are connected together by a fastener upon a threaded reinforcing bar.
Figure 13B:
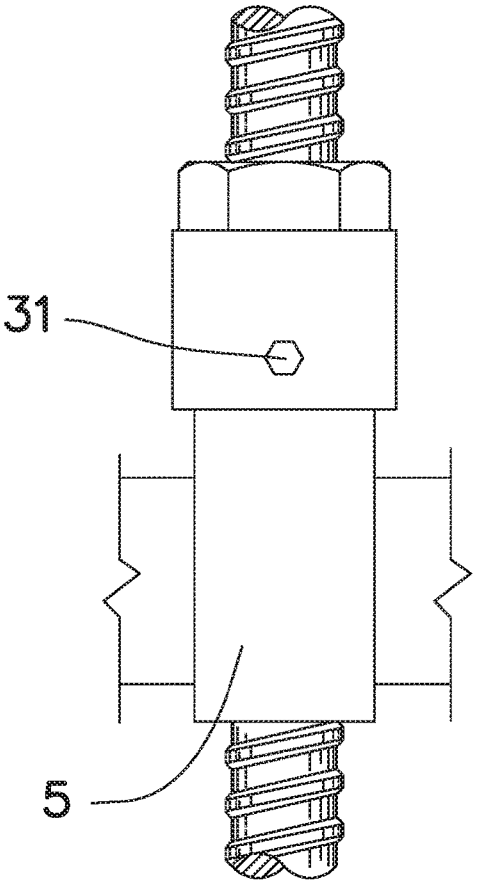
FIG. 13B is an elevation view of the sleeve and sleeve lock with one or more fasteners in FIG. 13A after they have been connected together by a fastener upon a threaded reinforcing bar.
Figure 14A:
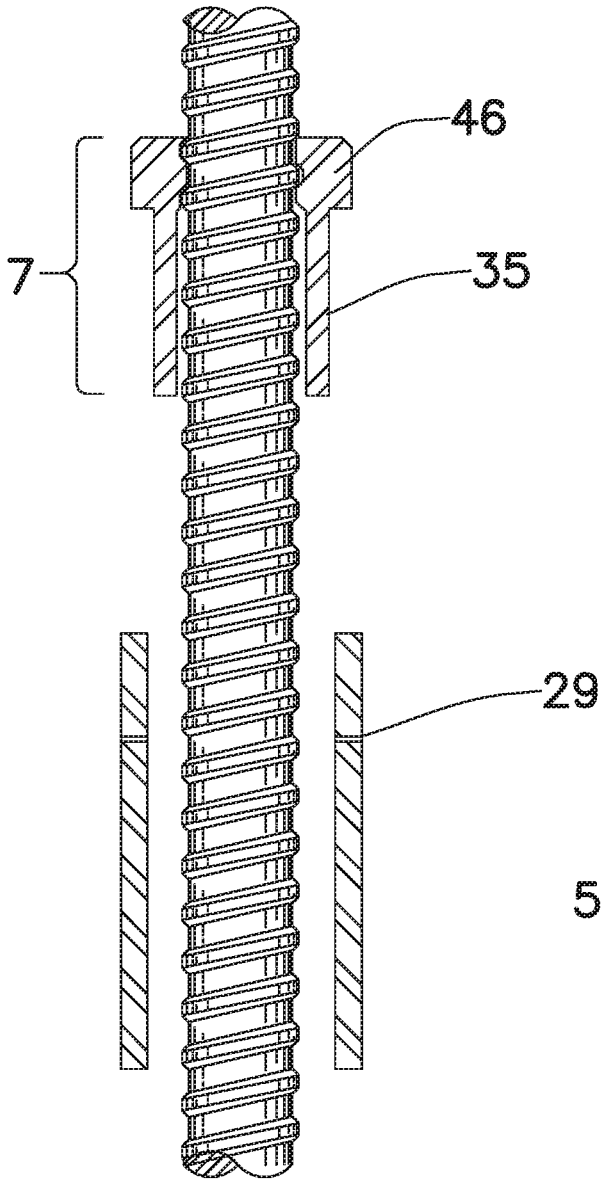
FIG. 14A is a cross sectional view of the sleeve, sleeve lock and internal makeup spacer sleeve shown in FIG. 12A.
Figure 14B:
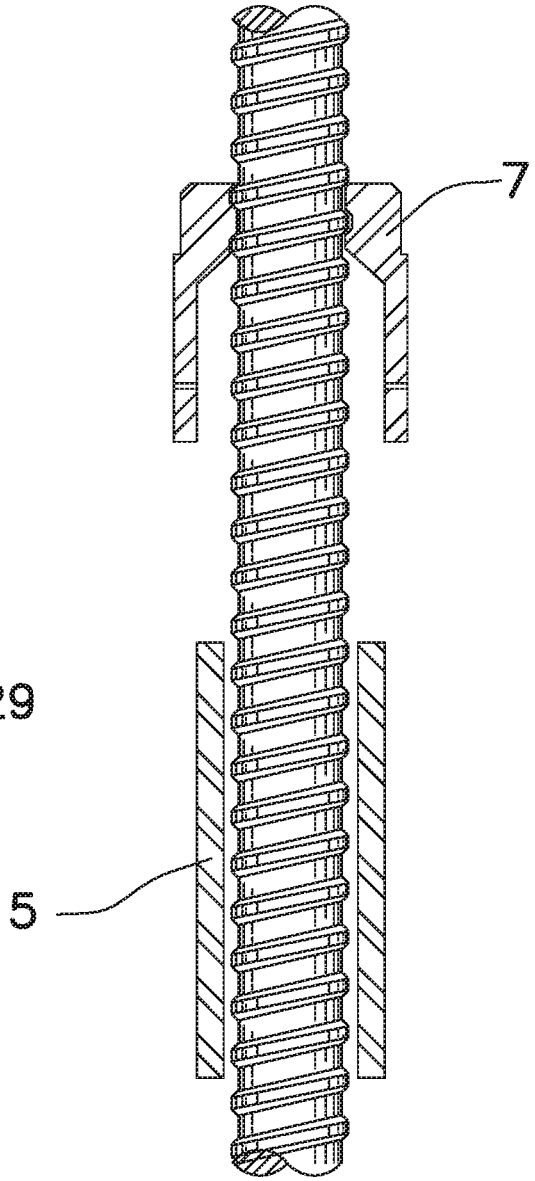
FIG. 14B is a cross sectional view of the sleeve and sleeve lock with the one or more fasteners shown in FIG. 13A.

Referring to FIGS. 13A, 13B and 14B, the objects of the above described embodiment can be similarly achieved with at least one sleeve lock (7), as in FIGS. 3A and 3B that is fastened to the sleeve (5) with one or more fasteners (31). The sleeve lock (7) is similarly preferably comprised of a steel cylindrical section having internal threading that is complimentary to the external threading pattern of the longitudinally extending reinforcing bars (1) over the portion of its length that is outside of the overlapping length between external makeup sleeve (37) and the smooth bore sleeve (5). The sleeve lock (7) and respective smooth bore sleeve (5) are of a size and shape to allow the sleeve lock (7) to travel freely over the smooth bore sleeve (5). The annular space between the two is preferably minimized to ensure snugness. A bushing (not shown), made preferably of plastic, can be inserted into the annular space between the two to achieve the desired snugness, while still ensuring free movement At least one fastener (31) is installed through plain or thread tapped holes (29) in the sleeve lock (7). The fasteners (31) are preferably provided with pointed tips.

Figure 15A:
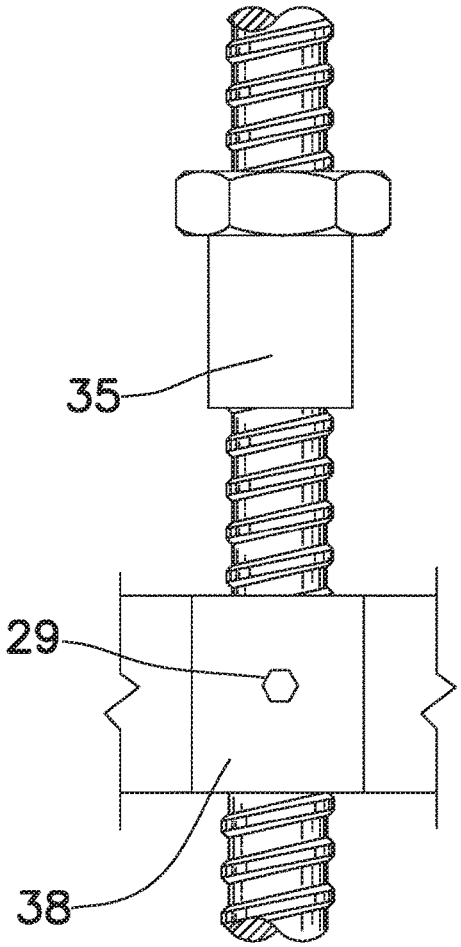
FIG. 15A is an elevation view of the embodiment shown in FIG. 12A with a non-cylindrical sleeve.
Figure 15B:
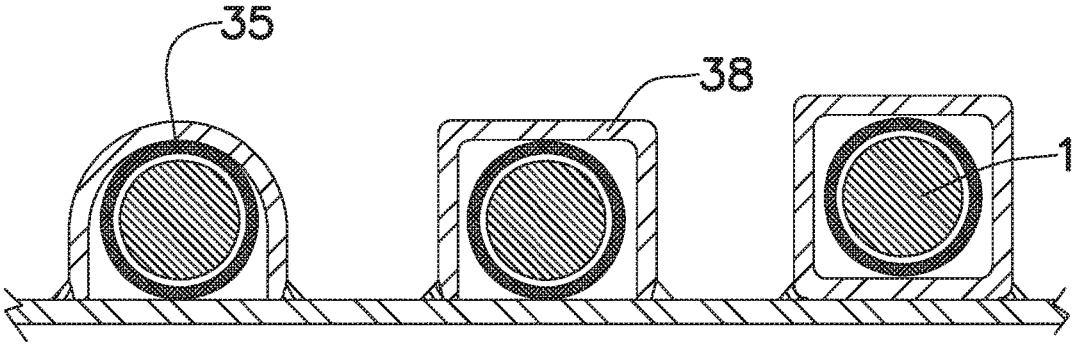
FIG. 15B is a plan cross sectional view from above of the embodiment of FIG. 15A for various non-cylindrical shaped sleeves.
Figure 16:
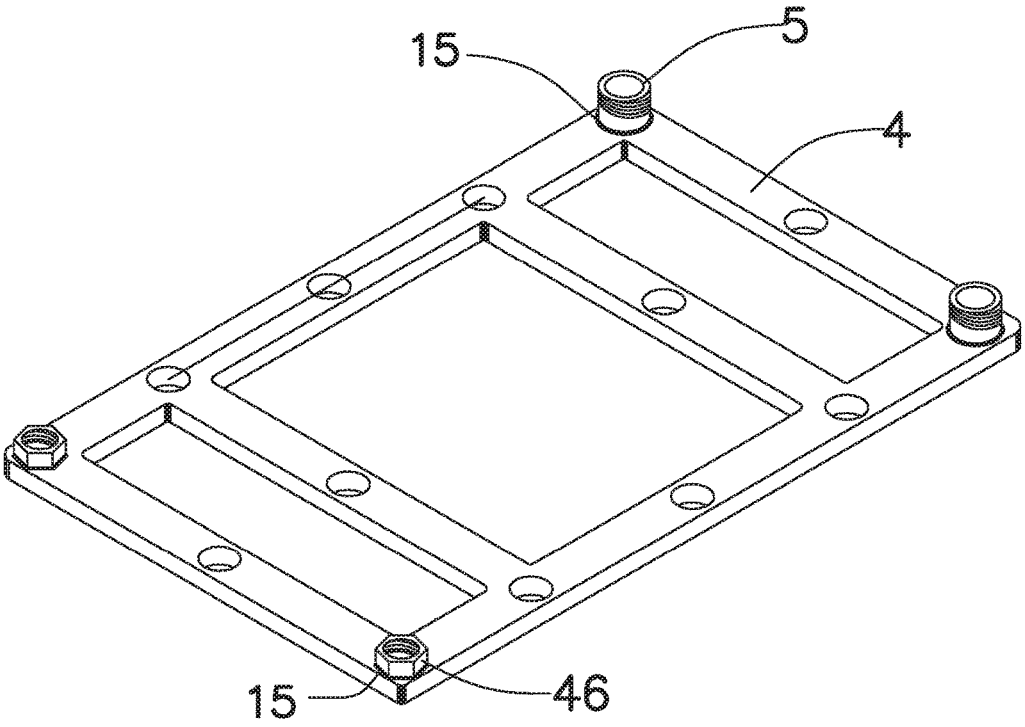
FIG. 16 is an isometric view of another embodiment of the present invention with the sleeves and internally threaded collars of the present invention adapted for use with flat templates holding reinforcing bars vertically in place.
Figure 17A:
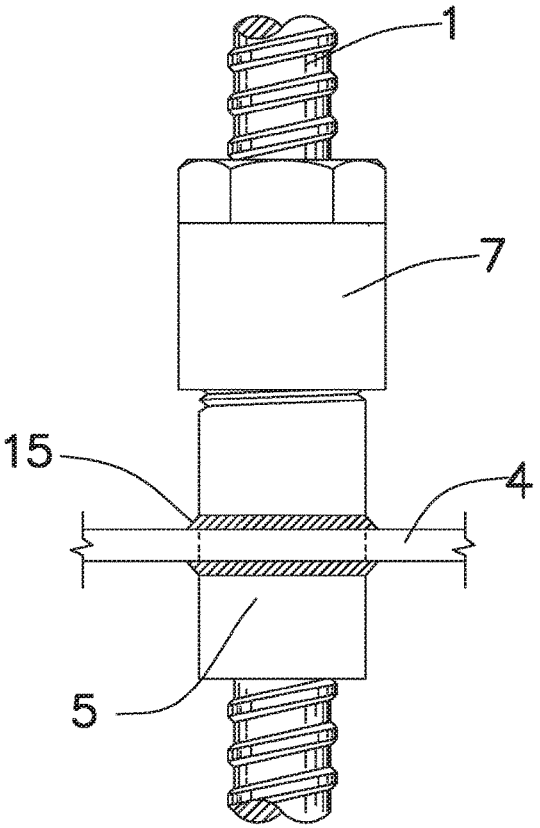
FIG. 17A is an elevation view of the embodiment shown in FIG. 16 with the sleeve extending through the template.
Figure 17B:
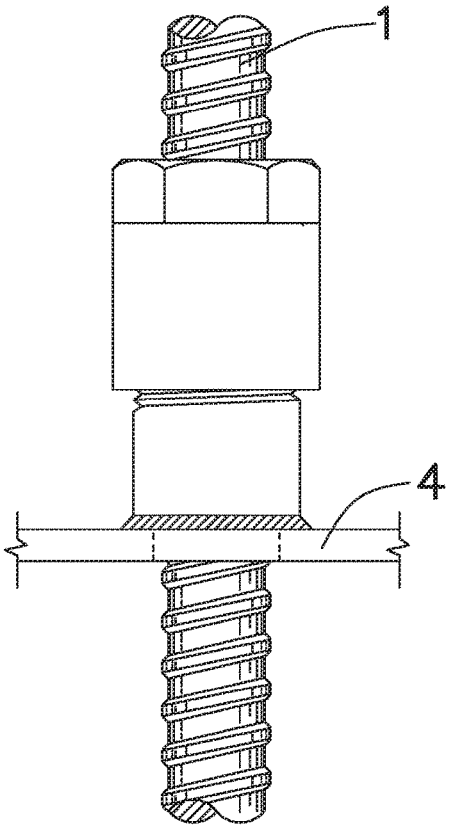
FIG. 17B is an elevation view of the embodiment for FIG. 16 with the sleeve attached to one face of the template.

Referring to FIGS. 15A and 15B, the embodiments of FIGS. 11A-11B and FIGS. 12A-12B can be similarly used with the non-cylindrical sleeves (38) of Bongiorno '287 Referring to FIGS. 16-17B, the embodiments thus far described can be adapted to the flat templates of Ferrer '479 and Ferrer '678, by attaching sleeves (5) to one face of the template (4) over a respective hole in the template. The sleeves (5) are fastened to the face of the template by suitable means but preferably by welding (15). Alternatively, separate sleeves (5) can be attached to opposite faces of the template (4) over a respective hole in the template (4). In yet another alternative, a continuous sleeve (5) is adapted to pass through a respective hole in the template (4), extending at least partially beyond each opposite face of the template (4) and the sleeve (5) is then fastened to at least one face of the template by suitable means such as welding (15). The thus attached sleeve (5) can be adapted to all previous embodiments to achieve the objects of the present invention with the templates (4) of Ferrer '479 and Ferrer '678.

Figure 18:
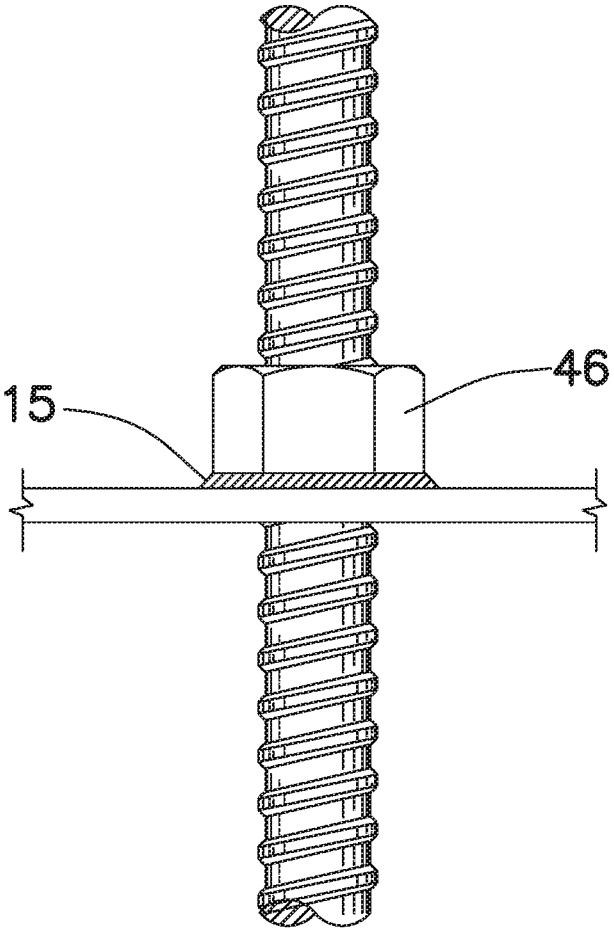
FIG. 18 is an elevation view of the embodiment for FIG. 16 with the internally threaded collar attached to one face of the template.
Figure 19A:
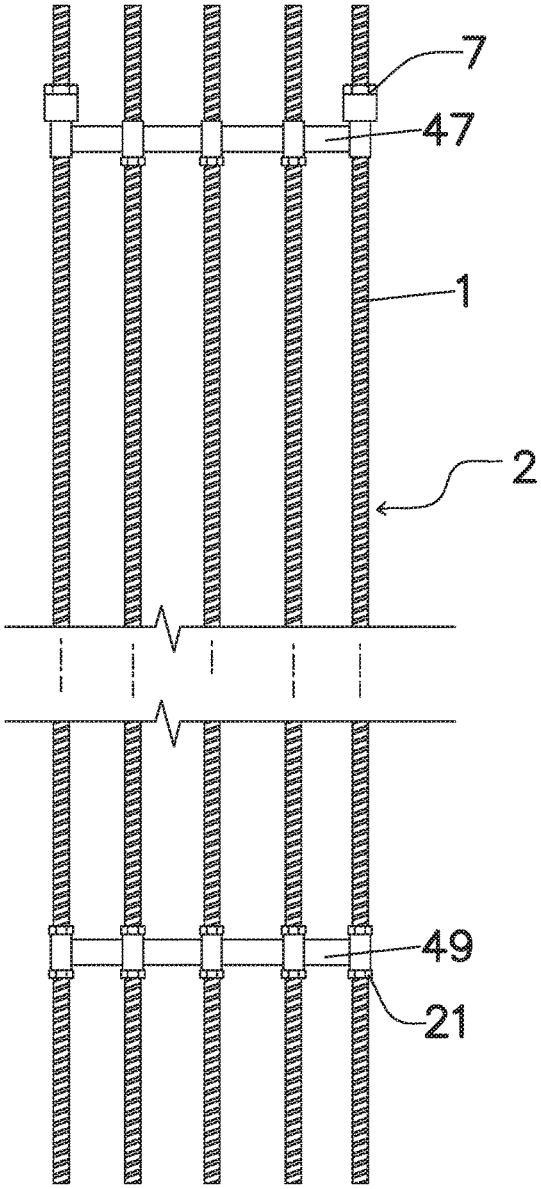
FIG. 19A is an elevation view of one embodiment of the present invention having the sleeve locks of the present invention adapted to a cage frame of Bongiorno '287 in the upper portion and with a cage frame of Bongiorno '287 in the lower portion.
Figure 19B:
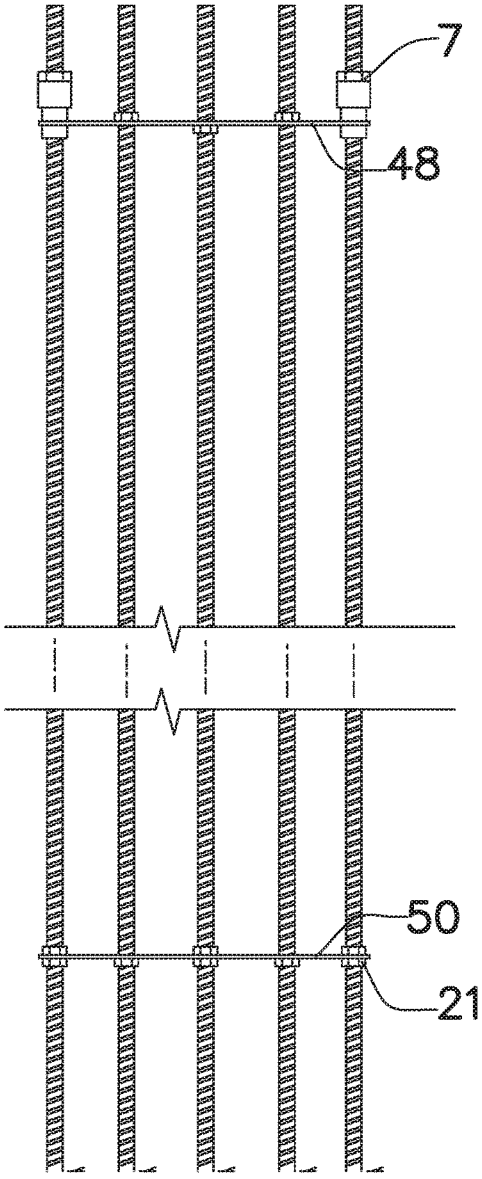
FIG. 19B is an elevation view of one embodiment of the present invention having the sleeve locks of the present invention adapted to a template of Ferrer '479 and Ferrer '678 in the upper portion and with template of Ferrer '479 and Ferrer '678 in the lower portion.
Figure 20A:
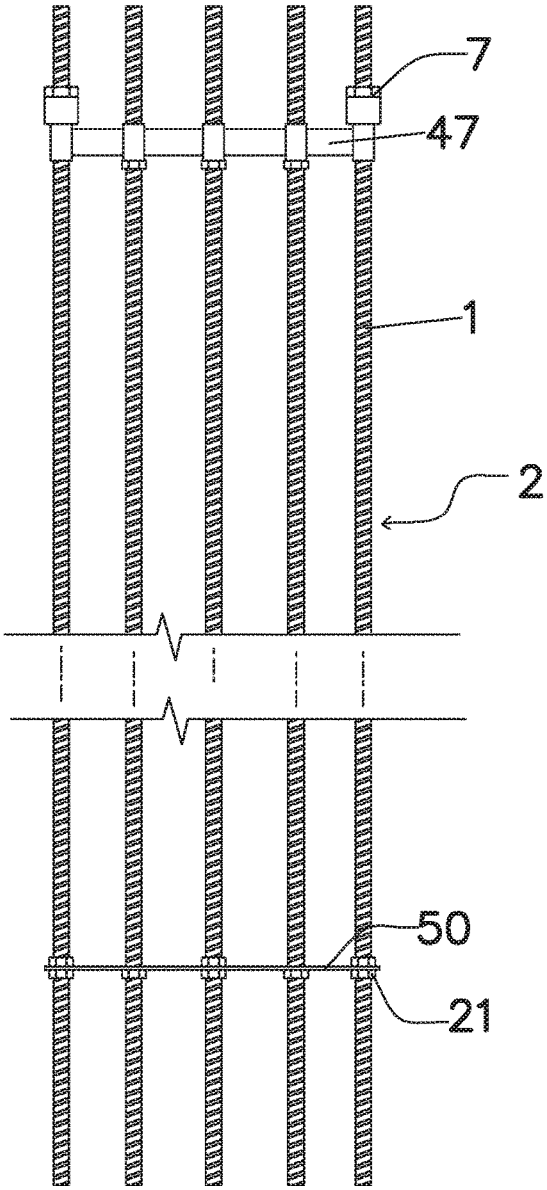
FIG. 20A is an elevation view of one embodiment of the present invention having the sleeve locks of the present invention adapted to a cage frame of Bongiorno '287 in the upper portion and with a template of Ferrer '479 and Ferrer '678 in the lower portion.
Figure 20B:
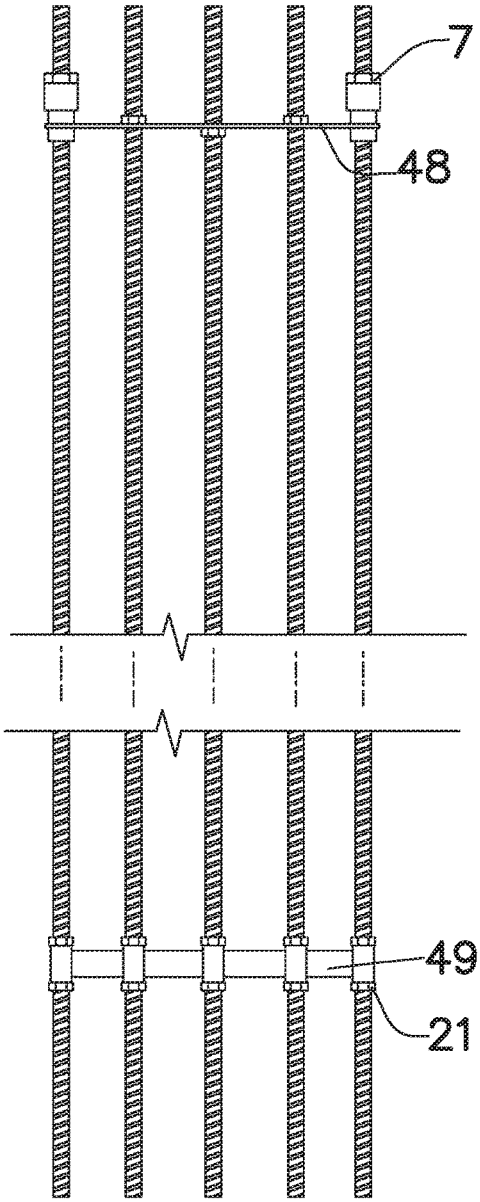
FIG. 20B is an elevation view of one embodiment of the present invention having the sleeve locks of the present invention adapted to a template of Ferrer '479 and Ferrer '678 in the upper portion and with a cage frame of Bongiorno '287 in the lower portion.

Referring to FIGS. 16 and 18, the embodiment of FIGS. 7A-7B incorporating an internally threaded lock collar (23), can be adapted to the flat templates of Ferrer '479 and Ferrer '678 with the same procedure described for use with the cage frames of Bongiorno '287.

Possible Modifications and Variations

The foregoing description of one or more embodiments of the present invention has been presented for the purposes of illustration and description. While the foregoing detailed description of the invention enables one of ordinary skill to make and use the invention, those skilled in the art will understand and appreciate the existence of variations, modifications, combinations and equivalents of the specific embodiments and methods presented. It is understood that changes in the specific embodiments and methods shown and described may be made within the scope of the description without departing from the spirit of the invention. For example, the sleeve locks, internally threaded lock collars and compression nuts can be of any shape. As another example, the sleeve locks, internally threaded lock collars and compression nuts can be provided on both ends of the sleeves. As yet another example, the minor threads on the sleeve can be provided on the inside face of the sleeve and the corresponding minor threads of the lock sleeve can be made on the exterior face. Alternative methods of fastening using, for example, screws, bolts, welds, adhesives, etc. may be used. Additionally, the various components of the present invention can be comprised of alternative suitable materials that those generally described.

I claim:

1. A method of constructing and mounting a pre-fabricated reinforcement retainer assembly of retainers for stabilizing concrete reinforcement bars in place at a construction site, comprising the steps of:

positioning a plurality of spaced, horizontally arranged concrete reinforcing bars, said reinforcing bars having an external threading pattern over at least a portion of their length;

providing a plurality of spaced rigid support structure retainers for axially aligning said reinforcing bars;

said retainers each having a plurality of axially extending holes;

providing at least one retaining sleeve to said spaced rigid support structure retainer for insertion of a respective concrete reinforcing steel bar therein;

mounting at least one sleeve lock onto a respective concrete reinforcing bar to engage and lock said at least one retaining sleeve in place on said respective reinforcing bar, while said at least one concrete respective reinforcing bar is horizontally arranged;

lifting said reinforcement retainer assembly into place thereby avoiding use of workers to climb up said reinforcement retainer assembly for tightening nuts used for holding an upper retainer against said reinforcement cage.

2. The method of claim 1 wherein said spaced rigid support structure retainers comprise three dimensional cage frames having integral spaced apart open cage frame sleeves for insertion of each respective concrete reinforcing bar therein.

3. The method of claim 2 wherein said at least one retaining sleeve of said spaced rigid support structure retainer is said integral spaced apart open cage frame sleeve.

4. The method of claim 2 wherein said at least one retaining sleeve of said spaced rigid support structure retainer comprises a separate mountable sleeve.

5. The method of claim 2 in which each said at least one retaining sleeve is at least partially threaded on an outside surface thereof, and each said sleeve lock is a threadable member having a first set of threads for engaging threads on said reinforcement bar and a second set of threads for engaging threads on said at least one retaining sleeve for locking said at least one retaining sleeve in place.

6. The method of claim 1 wherein said spaced rigid support structure retainers comprise flat templates having spaced apart holes for insertion of each respective concrete reinforcing bar therein.

7. The method of claim 6 wherein said retaining sleeve of said spaced rigid support structure retainer comprises a separate mountable sleeve.

8. The method of claim 6 wherein said mountable at least one retaining sleeve is one mountable smooth bore sleeve, welded to at least one side of said flat template retainer.

9. The method of claim 6 wherein said separate mountable sleeve comprises a pair of mountable smooth bore sleeves, each welded to both sides of said flat template retainer.

10. The method of claim 1 in which said sleeve lock is comprised of a single piece.

11. The method of claim 1 in which said sleeve lock is comprised of separate pieces joined together.

12. The method of claim 1 in which said sleeve lock is welded to a respective cage sleeve.

13. The method of claim 1 in which each said at least one retaining sleeve has a smooth inner surface and at least one set of outer threads adjacent an end thereof, said sleeve lock further comprising at least one internally threaded compression ring threaded on the respective reinforcement bar under an end of said sleeve lock, and upon an end of said retaining sleeve, and said sleeve lock has inner threads engageable with said outer threads of said at least one retaining sleeve to lock said retaining sleeve in place adjacent to, and spaced apart from, said threaded reinforcement bar.

14. The method of claim 1 in which each said at least one retaining sleeve has a smooth inner bore, a makeup collar threaded onto said reinforcement bar within said at least one retaining sleeve, a bushing between said makeup collar and an inner surface of said at least one retaining sleeve, and at least one fastener extending through said at least one retaining sleeve to lock said makeup collar, bushing and at least one retaining sleeve in place, said makeup collar and respective at least one retaining sleeve with a smooth bore being of a size and shape to allow said threaded makeup collar to travel freely with said smooth bore.

15. The method of claim 14 in which said makeup collar has a rotatable sleeve lock attached at one end thereto.

16. The method of claim 1 in which each said at least one retaining sleeve has a smooth inner bore, a bushing is inserted between said reinforcement bar and an inner surface of said cage sleeve, and lock collars are threaded onto said reinforcement bar against opposite ends of said cage sleeve.

17. The method of claim 1 in which a makeup sleeve is threaded onto said reinforcement bar to engage said at least one retaining sleeve, and a fastener is mounted on said at least one retaining sleeve to lock said at least one retaining sleeve and makeup sleeve in place.

18. The method of claim 17 in which said makeup sleeve extends into said cage sleeve.

19. The method of claim 17 in which said makeup sleeve overlaps said cage sleeve.

20. The method of claim 1 wherein said mounted sleeve lock is a nut welded to at least one end of said rigid support structure retainer.

21. The method of claim 1 wherein the orientation of the lifting is upwardly.

22. The method of claim 1 wherein the orientation of the upward lifting is substantially vertical.

23. The method of claim 1 wherein at least one of said spaced rigid support structure retainers comprises a three dimensional cage frame having integral spaced apart open cage frame sleeves for insertion of each respective concrete reinforcing bar therein and wherein at least one of said spaced rigid support structure retainers comprises a flat template having spaced apart holes for insertion of each respective concrete reinforcing bar therein.

* * * * *